US009987867B2

(12) United States Patent
Miyauchi

(10) Patent No.: US 9,987,867 B2
(45) Date of Patent: Jun. 5, 2018

(54) THERMAL TRANSFER IMAGE RECEIVING SHEET AND METHOD FOR FABRICATING THE SAME

(71) Applicant: TOPPAN PRINTING CO., LTD., Taito-ku (JP)

(72) Inventor: Yasuhiro Miyauchi, Taito-ku (JP)

(73) Assignee: TOPPAN PRINTING CO., LTD., Taito-ku (JP)

( * ) Notice: Subject to any disclaimer, the term of this patent is extended or adjusted under 35 U.S.C. 154(b) by 0 days. days.

(21) Appl. No.: 15/407,393

(22) Filed: Jan. 17, 2017

(65) Prior Publication Data

US 2017/0120653 A1 May 4, 2017

Related U.S. Application Data

(63) Continuation of application No. PCT/JP2015/003559, filed on Jul. 14, 2015.

(30) Foreign Application Priority Data

Jul. 17, 2014 (JP) ..... 2014-146979

(51) Int. Cl.
*B41M 5/44* (2006.01)
*B41M 5/52* (2006.01)
*B41M 5/50* (2006.01)

(52) U.S. Cl.
CPC ..... *B41M 5/44* (2013.01); *B41M 5/506* (2013.01); *B41M 5/5254* (2013.01); *B41M 5/5281* (2013.01); *B41M 2205/02* (2013.01); *B41M 2205/32* (2013.01); *B41M 2205/38* (2013.01)

(58) Field of Classification Search
CPC .... B41M 5/382; B41M 5/38214; B41M 5/42; B41M 5/44; B41M 5/50; B41M 5/502506; B41M 5/52; B41M 5/5254; B41M 5/5263; B41M 5/5281; B41M 2205/02; B41M 2205/32; B41M 2205/38
USPC ..... 503/227; 428/32.39
See application file for complete search history.

(56) References Cited

FOREIGN PATENT DOCUMENTS

| | | | |
|---|---|---|---|
| JP | 4-099697 | A | 3/1992 |
| JP | 4-103395 | A | 4/1992 |
| JP | 2009-160829 | A | 7/2009 |
| JP | 2012-196958 | A | 10/2012 |
| JP | 2012-214017 | A | 11/2012 |

OTHER PUBLICATIONS

International Search Report dated Aug. 11, 2015 in PCT/JP2015/003559, filed Jul. 14, 2015.

*Primary Examiner* — Bruce H Hess
(74) *Attorney, Agent, or Firm* — Oblon, McClelland, Maier & Neustadt, L.L.P.

(57) ABSTRACT

A thermal transfer image receiving sheet including a substrate having a surface, a heat-insulating layer formed on the surface, an undercoat layer formed on the heat-insulating layer, and a dye-receiving layer formed on the undercoat layer. The undercoat layer includes as a main component a polycondensate made from i) at least one of an alkoxide, a hydrolyzate of an alkoxide, and tin chloride, ii) a water-soluble polymer, iii) a vinyl pyrrolidone-vinyl imidazole copolymer, and iv) a urethane resin.

16 Claims, 1 Drawing Sheet

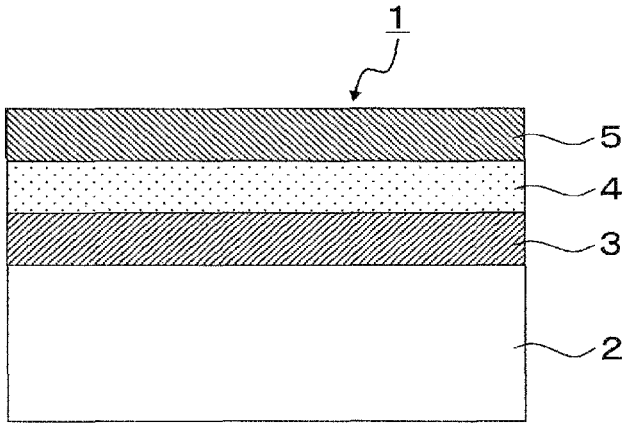
1
5
4
3
2

THERMAL TRANSFER IMAGE RECEIVING SHEET AND METHOD FOR FABRICATING THE SAME

CROSS-REFERENCE TO RELATED APPLICATIONS

The present application is a continuation of International Application No. PCT/JP2015/003559, filed Jul. 14, 2015, which is based upon and claims the benefits of priority to Japanese Application No. 2014-146979, filed Jul. 17, 2014. The entire contents of these applications are incorporated herein by reference.

BACKGROUND OF THE INVENTION

Field of the Invention

This invention relates to a thermal transfer image receiving sheet and a method for fabricating the same.

Discussion of the Background

The thermal transfer image receiving sheet used for thermal transfer printers includes, for example, one which is formed by successively stacking, on one surface of a substrate, a heat-insulating layer, an undercoat layer and a dye-receiving layer. The techniques on the thermal transfer image receiving sheet include those descried, for example, in the following Patent Literatures 1 to 5.

PTL 1: JP-A-2009-160829
PTL 2: JP-A-Hei 4-103395
PTL 3: JP-A-Hei 4-99697
PTL 4: JP-A-2012-196958
PTL 5: JP-A-2012-214017

SUMMARY OF INVENTION

According to one aspect of the present invention, a thermal transfer image receiving sheet includes a substrate having a surface, a heat-insulating layer formed on the surface, an undercoat layer formed on the heat-insulating layer, and a dye-receiving layer formed on the undercoat layer. The undercoat layer includes as a main component a polycondensate made from i) at least one of an alkoxide, a hydrolyzate of an alkoxide, and tin chloride, ii) a water-soluble polymer, iii) a vinyl pyrrolidone-vinyl imidazole copolymer, and iv) a urethane resin.

According to another aspect of the present invention, a method of manufacturing a thermal transfer image receiving sheet includes forming a layered structure on a surface of a substrate such that a heat-insulating layer is formed on the surface, an undercoat layer is formed on the heat-insulating layer, and a dye-receiving layer is formed on the undercoat layer. The forming of the layered structure includes forming the undercoat layer on the heat-insulating layer by coating a solution to the heat-insulating layer and drying after the coating, and the solution has a composition such that the undercoat layer includes as a main component a polycondensate made from i) at least one of an alkoxide, a hydrolyzate of an alkoxide, and tin chloride, ii) a water-soluble polymer, iii) a vinyl pyrrolidone-vinyl imidazole copolymer, and iv) a urethane resin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a side sectional view of a thermal transfer image receiving sheet related to an embodiment of the invention.

DESCRIPTION OF THE EMBODIMENTS

The embodiments will now be described with reference to the accompanying drawings, wherein like reference numerals designate corresponding or identical elements throughout the various drawings.

The embodiments of the invention are now described in more detail. It will be noted that in the following detailed illustration, a number of specific details have been described so as to provide complete understanding of the embodiments of the invention. However, it will be apparent that if such details are not provided, one or more embodiments are feasible. Besides, for simplicity of the drawing, known structures and devices are schematically shown.

(Configuration of Thermal Transfer Image Receiving Sheet 1)

FIG. 1 is a side sectional view of a thermal transfer image receiving sheet 1. The thermal transfer image receiving sheet 1 of this embodiment is comprised, at least, of a substrate 2, a heat-insulating layer 3, an undercoat layer 4 and a dye-receiving layer 5 stacked in this order. The present embodiment is characterized by the undercoat layer 4.

Hitherto known ones can be used as the substrate 2 and include, for example, films of synthetic resins including polyesters such as polyethylene terephthalate, polyethylene naphthalate and the like, polyolefins such as polypropylene, polyethylene and the like, polyvinyl chloride, polycarbonates, polyvinyl alcohol, polystyrene, polyamides and the like, and papers such as high-quality paper, medium-quality paper, coated paper, art paper, resin-laminated paper and the like. These may be used singly or in combination as a composite material.

When toughness, strength and heat resistance sufficient to use as a printed matter are taken into account, the thickness of the substrate 2 may be within a range of from 25 μm to 250 μm, preferably within a range of from 50 μm to 200 μm.

Next, the heat-insulating layer 3 provided on one surface of the substrate 2 can be one that is made of the same type of material as the heat-insulating layer of hitherto known thermal transfer image receiving sheets. The heat-insulating layer 3 include, for example, ones which are constituted of hollow particles and a binder resin, make use of a foamed film, such as a foamed polypropylene film, a foamed polyethylene terephthalate film or the like, and also make use of a composite film wherein a skin layer is formed on one or opposite surfaces of a foamed film. In this regard, when smoothness and glossiness influencing the image quality are taken into consideration, it is preferred to use as the heat-insulating layer 3 a composite film made of a foamed film having a skin layer formed on one or opposite surfaces thereof.

The usable thickness of the heat-insulating layer 3 is within a range of from 10 μm to 80 μm, preferably within a range of from 20 μm to 60 μm.

Next, the dye image-receiving layer 5 formed on the outermost surface of the substrate 2 on the side of the heat-insulating layer 3 can be one, which makes use of the same type of material of the dye image-receiving layer of hitherto known thermal transfer image receiving sheets, and should contain, at least, a binder resin and a release agent.

The binder resins used for the dye image-receiving layer 5 include, for example, polyvinyl butyral, polyvinyl acetoacetal, polyesters such as polyethylene terephthalate, polyethylene naphthalate and the like, polyvinyl chloride, polyvinyl acetate, vinyl chloride-vinyl acetate copolymers, polyethylene, ethylene-vinyl acetate copolymers, vinyl chloride-acrylic copolymers, styrene-acrylic copolymers, polybutadiene, polyolefins such as polypropylene, polyethylene and the like, polyurethanes, polyamides, polystyrene, polycaprolactones, epoxy resins, ketone resins, and modified resins thereof. Of these, the use of vinyl chloride-vinyl acetate copolymer is preferred.

The release agents used for the dye image-receiving layer 5 includes, for example, various types of silicone, fluorine and phosphoric acid ester oils, surfactants, various types of fillers such as metal oxides, silica and the like, waxes, and the like. These may be used singly or in admixture of two or more. Of these, the use of a silicone oil is preferred.

The usable thickness of the dye image-receiving layer 5 is within a range of from 0.1 μm to 10 μm, preferably within a range approximately of from 0.2 μm to 8 μm. The dye image-receiving layer 5 may further comprise known additives including, for example, a crosslinking agent, an antioxidant, a fluorescent dye and the like, if necessary.

The thermal transfer image receiving sheet 1 of the present embodiment has at least the undercoat layer 4 between the heat-insulating layer 3 and the dye image-receiving layer 5. The undercoat layer 4 of this embodiment is comprised mainly of a polycondensate, which is formed by using at least one of an alkoxide, a hydrolyzate of an alkoxide and tin chloride, a water-soluble polymer, a vinyl pyrrolidone-vinyl imidazole copolymer, and a urethane resin. The main component used in the present specification means, for example, a component that is present in an amount exceeding 50 mass % relative to the total amount of the undercoat layer 4.

The undercoat layer 4 is formed by coating, onto the heat-insulating layer 3, and drying a coating solution (a coating solution for undercoat layer formation) comprising at least one of an alkoxide, a hydrolyzate of an alkoxide and tin chloride, a water-soluble polymer, a vinyl pyrrolidone-vinyl imidazole copolymer, and a urethane resin. As will become apparent from the examples described hereinafter, the use of this undercoat layer 4 enables the provision of a thermal transfer image receiving sheet, which is very high in print density and good in adhesion with the adjacently stacked heat-insulating layer 3 and/or dye-receiving layer 5 when high-speed printing is performed by use of existing high-speed printers, and which is able to mitigate the generation of glitter when the high-speed printing is carried out under high temperature and high humidity environments.

Aside from the at least one of an alkoxide, a hydrolyzate of an alkoxide and tin chloride, the water-soluble polymer, the vinyl pyrrolidone-vinyl imidazole copolymer and the urethane resin, the main component in the present specification may further comprise other types of components unless the effects of the print density and adhesion to a substrate as desired in the embodiments of the invention are impaired.

The total amount of the at least one of an alkoxide, a hydrolyzate of an alkoxide and tin chloride, the water-soluble polymer, the vinyl pyrrolidone-vinyl imidazole copolymer and the urethane resin is preferably greater than 50 mass %, more preferably not less than 80 mass %, relative to the total of the undercoat layer 4 after its formation.

The alkoxide, the hydrolyzate of an alkoxide and tin chloride used for the formation of the undercoat layer 4 are each a reactive inorganic component. During the course of drying in an aqueous solution, they undergo self-polycondensation reaction to form polymers having linear or three-dimensional structures, respectively. Besides, they are considered to form, on a molecular level, composites with the water-soluble polymer, urethane resin and vinyl pyrrolidone-vinyl imidazole copolymer. Accordingly, it is considered that the polycondensation products with the at least one of the alkoxide contained in the undercoat layer 4, the hydrolyzate of an alkoxide and tin chloride not only contribute to more improving the print density at the time of high-speed printing, but also contribute to improving the adhesion between the undercoat layer 4 and the heat-insulating layer 3 or/and the adhesion between the undercoat layer 4 and the dye-receiving layer 5, which are insufficient when using the water-soluble polymer alone.

Furthermore, the urethane resin is considered to contribute to further improving the adhesion between the undercoat layer 4 and the heat-insulating layer 3 or/and the adhesion between the undercoat layer 4 and the dye-receiving layer 5. Thus, the provision of the urethane resin leads to the development of such an effect that the generation of abnormal transfer can be prevented in the case where higher speed printing is performed.

It is considered that the vinyl pyrrolidone-vinyl imidazole copolymer serves in such a way that the vinyl imidazole component makes up for the poor heat and humidity resistances of the water-soluble polymer component and the vinyl pyrrolidone component. Moreover, when the vinyl pyrrolidone-vinyl imidazole copolymer is provided, there can be shown the effect of mitigating the generation of glitter involved in the high-speed printing under high temperature and high humidity environments.

The alkoxide used for the undercoat layer 4 includes, for example, those represented by the following formula (1) such as tetraethoxysilane $[Si(OC_2H_5)_4]$, triisopropoxy aluminum $[Al(O—C_3H_7)_3]$ (wherein $—C_3H_7$ is an isopropyl-allyl group) and the like. Of these, tetraethoxysilane or triisopropoxy aluminum is preferred because of its relative stability in an aqueous solvent.

$$M(OR)_n \quad (1)$$

(In the general formula (1), M represents a metal such as Si, Ti, Al, Zr or the like, R represents an alkyl group such as $CH_3$, $C_2H_5$ or the like, and n is an integer of 1 to 4 that differs depending on the type of M.)

The hydrolyzate of an alkoxide includes, for example, a hydrolyzate of tetraethoxysilane or triisopropoxy aluminum.

The alkoxide used for the undercoat layer 4 may be a mixture of tetraethoxysilane and triisopropoxy aluminum indicated above.

The tin chloride used for the undercoat layer 4 includes stannous chloride ($SnCl_2$), stannic chloride ($SnCl_3$) or a mixture thereof. An anhydride or a hydrate thereof may also be used.

In short, according to the present embodiment, an alkoxide, a hydrolyzate of an alkoxide and tin chloride may be used singly or in admixture.

The urethane resin used for the undercoat layer 4 includes an emulsion-type polyurethane resin obtained, for example, by emulsifying an ester polyurethane resin, an ether polyurethane resin, a carbonate polyurethane resin or the like with an emulsifier, and an ionomer-type polyurethane resin that is imparted with water solubility by partially binding a metal salt or ammonium salt of a carboxylic acid or sulfonic acid to an ester polyurethane resin, an ether polyurethane resin, a carbonate polyurethane resin or the like. In view of the waterproofness, a plasticizer resistance and a heat resistance, it is preferred to use an emulsion-type polyester urethane resin obtained by emulsifying an ester polyurethane resin having a carboxyl group, or an ionomer-type polyurethane resin.

The urethane resin used for the undercoat layer 4 may be a mixture of the emulsion-type polyurethane resin and the ionomer-type polyurethane resin indicated above.

The water-soluble polymers used for the undercoat layer 4 include, for example, polyvinyl alcohol, polyvinyl pyrrolidone, starch, gelatin, methyl cellulose, ethyl cellulose, carboxymethyl cellulose, sodium alginate and the like. Of these, polyvinyl alcohol and polyvinyl pyrrolidone are preferred, of which polyvinyl alcohol is more preferred. It will be noted that the polyvinyl alcohol used herein means one that is generally obtained by saponifying polyvinyl acetate and includes those covering from so-called partially saponified polyvinyl alcohol wherein several tens of percent of an acetic acid group are left to so-called completely saponified polyvinyl alcohol wherein only several percent of an acetic acid group is left. Thus, no specific limitation is placed thereon.

The water-soluble polymer used for the undercoat layer 4 may be a mixture of such polyvinyl alcohol and polyvinyl pyrrolidone as indicated above.

The vinyl pyrrolidone-vinyl imidazole copolymer used for the undercoat layer 4 means a copolymer of an N-vinyl pyrrolidone monomer and a vinyl imidazole that is a vinyl polymerizable monomer. The manner of copolymerization includes random copolymerization, block copolymerization, graft copolymerization or the like although not limited to any of them. It is to be noted that the N-vinyl pyrrolidone monomer means N-vinyl pyrrolidones (such as N-vinyl-2-pyrrolidone, N-vinyl-4-pyrrolidone and the like) and derivatives thereof. The derivatives of the N-vinyl pyrrolidones (such as N-vinyl-2-pyrrolidone, N-vinyl-4-pyrrolidone and the like) include those having a substituent on the pyrrolidone ring, such as N-vinyl-3-methylpyrrolidone, N-vinyl-5-methylpyrrolidone, N-vinyl-3-benzylpyrrolidine, N-vinyl-3,3,5-trimethylpyrrolidine and the like although not limited specifically thereto.

The undercoat layer 4 is formed by coating and drying, on the heat-insulating layer 3, a coating solution comprising, as main components, at least one of an alkoxide, a hydrolyzate of an alkoxide and tin chloride, a water-soluble polymer, a vinyl pyrrolidone-vinyl imidazole copolymer and a urethane resin. The formulation ratio between the water-soluble polymer and "the component constituted of at least one of an alkoxide, a hydrolyzate of an alkoxide and tin chloride", the formulation ratio between the water-soluble polymer and the urethane resin, and the formulation ratio between the water-soluble polymer and the vinyl pyrrolidone-vinyl imidazole copolymer are, respectively, within a range of 9/1 to 1/9. In consideration of the print density at the time of high-speed printing, the adhesion between the undercoat layer 4 and the heat-insulating layer 3 or/and the adhesion between the undercoat layer 4 and the dye-receiving layer 5 and the glitter caused by high-speed printing under high temperature and high humidity environments, a more preferred range is at 8/2 to 2/8. The undercoat layer 4 or a coating solution for the formation of the undercoat layer may further contain known additives including, for example, a crosslinking agent such as an isocyanate compound, a whitening agent such as titanium oxide or the like, a fluorescent dye, a silane coupling agent, a dispels, a viscosity adjuster, a stabilizer and the like within ranges not impeding the above-stated performance.

The undercoat layer 4 having a thickness within a range of from 0.1 μm to 6 μm is usable and a preferred thickness is within a range of from 0.2 μm to 5 μm. If the thickness of the undercoat layer 3 is less than 0.1 μm, a difficulty is involved in the thickness adjustment of the undercoat layer 4. If the thickness of the undercoat layer 4 is varied at less than 1 μm, a variation is generated in the print density. Moreover, there may be some concern that a problem is involved in the adhesion between the undercoat layer 4 and the heat-insulating layer 3 or/and the adhesion between the undercoat layer 4 and the dye-receiving layer 5. On the other hand, when the thickness of the undercoat layer 4 exceeds 6 μm, there may be concern that the print density at the time of high-speed printing is saturated. Accordingly, the thickness of the undercoat layer 4 is preferably at not larger than 6 μm from the standpoint of costs.

The thermal transfer image receiving sheet 1 of the present embodiment may be provided with an adhesive layer (not shown) for bonding between the substrate 2 and the heat-insulating layer 3. The materials used for the adhesive layer may be the same ones as used for adhesive layers of hitherto known thermal transfer image receiving sheets. As the adhesive layer, there can be used, for example, a polyolefin resin such as polyethylene or the like, a urethane resin, an acrylic resin, a polyester resin, an epoxy resin, a phenolic resin, a vinyl acetate resin, or the like. Of these, polyethylene, a urethane resin, and an acrylic resin are preferred.

The thermal transfer image receiving sheet 1 of the embodiment may be provided with a back layer (not shown) on a side opposite to the side of the substrate 2 where the heat-insulating layer 3 is provided. The back layer is provided so as to improve printer transportability, prevent blocking with the dye-receiving layer 5 and prevent curling of the thermal transfer image receiving sheet 1 prior to or after printing. The materials used for the back layer may be same materials as used for back layers of hitherto known thermal transfer image receiving sheets. For the back layer, there can be used, for example, a binder resin including a polyolefin resin such as a polyethylene resin, a polypropylene resin or the like, an acrylic resin, a polycarbonate resin, a polyvinyl alcohol resin, a polyvinyl acetal resin, a polyester resin, a polystyrene resin, or a polyamide resin. The back layer may further contain known additives such as a filler, an antistatic agent and the like, if necessary.

(Method of Fabricating Thermal Transfer Image Receiving Sheet 1)

The method of fabricating the thermal transfer image receiving sheet 1 of the present embodiment is briefly described.

In this embodiment, the thermal transfer image receiving sheet 1 is formed by successively stacking, on one surface of a substrate 2, a heat-insulating layer 3, an undercoat layer 4 and a dye-receiving layer 5. It will be noted that the materials of the respective layers including the substrate 2, the heat-insulating layer 3, the undercoat layer 4 and the dye-receiving layer 5 have been already illustrated, and their illustration is omitted herein.

In the present embodiment, the heat-insulating layer 3 is initially formed on one surface of the substrate 2. For the formation of the heat-insulating layer 3, a melt extrusion method can be used, for example.

Next, a coating solution for forming the undercoat layer 4 is coated onto the heat-insulating layer 3 and dried to form the undercoat layer 4. The coating solution for the undercoat layer formation is so adjusted as to contain, as main components, at least one of an alkoxide, a hydrolyzate of an alkoxide and tin oxide, a water-soluble polymer, a vinyl pyrrolidone-vinyl imidazole copolymer and a urethane resin in the undercoat layer 4 after the formation. The urethane resin may be at least one of an ester polyurethane or an ionomer-type polyurethane resin. The water-soluble polymer may be at least one of polyvinyl alcohol and polyvinyl pyrrolidone. The alkoxide may be at least one of tetraethoxysilane and triisopropoxy aluminum.

Next, a coating solution for forming the dye-receiving layer 5 is coated onto the undercoat layer 4 and dried to form the dye-receiving layer 5.

In this way, the thermal transfer image receiving sheet 1 of the present embodiment is formed.

EXAMPLES

Now, Examples 1 to 16 of the present invention and Comparative Examples 1 to 15 are illustrated.

The materials used in the respective examples and comparative examples are shown. It will be noted that "parts" used herein is by mass unless otherwise specified. The invention should not be construed as limited to the examples.

Example 1

A 140 μm thick high-quality paper was used as a substrate, and a 30 μm thick first polyethylene resin layer was formed on one surface of the paper according to a melt extrusion method. A 40 μm thick heat-insulating layer was provided wherein a skin layer was formed on one surface of a foamed polypropylene film.

Next, a second polyethylene resin layer was formed by melt extrusion of a polyethylene resin between a surface of the substrate opposite to the side of the first polyethylene resin layer and a surface of the heat-insulating layer where no skin layer was provided, thereby bonding them together by sandwich lamination. The melt extruded second polyethylene layer was formed to have a thickness of 15 μm.

Next, a coating solution-1 for undercoat layer formation was coated on the skin layer side of the foamed polypropylene film in a dry thickness of 3 μm and dried. In this way, an undercoat layer related to Example 1 was formed. Moreover, a coating solution for dye-receiving layer formation was coated onto the undercoat layer in a dry thickness of 3 μm and dried to form a dye-receiving layer related to Example 1. Thus, a thermal transfer image receiving sheet of Example 1 was obtained.

<Coating Solution-1 for Undercoat Layer Formation>

| | |
|---|---|
| Stannous chloride | 2.0 parts |
| Methyl cellulose (Metolose SM4000, manufactured by Shin-Etsu Chemical Co., Ltd.) | 1.5 parts |
| Emulsion-type ether polyurethane | 2.5 parts |
| Vinyl pyrrolidone-vinyl imidazole copolymer | 1.5 parts |
| Pure water | 61.0 parts |
| Ethyl alcohol | 28.0 parts |
| Isopropyl alcohol | 3.5 parts |

<Coating Solution for Dye-Receiving Layer Formation>

| | |
|---|---|
| Vinyl chloride-vinyl acetate copolymer (Solbin C, manufactured by Nissin Chemical Industry Co., Ltd.) | 19.5 parts |
| Amino-modified silicone (KF-393, manufactured by Shin-Etsu Chemical Co., Ltd.) | 0.5 parts |
| Methyl ethyl ketone | 40.0 parts |
| Toluene | 40.0 parts |

Example 2

A thermal transfer image receiving sheet related to Example 2 was obtained in the same manner as in Example 1 except that in the thermal transfer image receiving sheet prepared in Example 1, the undercoat layer was formed using a coating solution-2 for undercoat layer formation having the following formulation.

<Coating Solution-2 for Undercoat Layer Formation>

| | |
|---|---|
| Stannous chloride | 2.0 parts |
| Methyl cellulose (Metolose SM4000, manufactured by Shin-Etsu Chemical Co., Ltd.) | 1.5 parts |
| Emulsion-type ester polyurethane | 2.5 parts |
| Vinyl pyrrolidone-vinyl imidazole copolymer | 1.5 parts |
| Pure water | 61.0 parts |
| Ethyl alcohol | 28.0 parts |
| Isopropyl alcohol | 3.5 parts |

Example 3

A thermal transfer image receiving sheet related to Example 3 was obtained in the same manner as in Example 1 except that in the thermal transfer image receiving sheet prepared in Example 1, the undercoat layer was formed using a coating solution-3 for undercoat layer formation having the following formulation.

<Coating Solution-3 for Undercoat Layer Formation>

| | |
|---|---|
| Stannous chloride | 2.0 parts |
| Polyvinyl alcohol (PVA 424H, manufactured by Kuraray Co., Ltd.) | 1.5 parts |
| Emulsion-type ether polyurethane | 2.5 parts |
| Vinyl pyrrolidone-vinyl imidazole copolymer | 1.5 parts |
| Pure water | 61.0 parts |
| Ethyl alcohol | 28.0 parts |
| Isopropyl alcohol | 3.5 parts |

Example 4

A thermal transfer image receiving sheet related to Example 4 was obtained in the same manner as in Example 1 except that in the thermal transfer image receiving sheet prepared in Example 1, the undercoat layer was formed using a coating solution-4 for undercoat layer formation having the following formulation.

<Coating Solution-4 for Undercoat Layer Formation>

| | |
|---|---|
| Tetraethoxysilane | 6.0 parts |
| Methyl cellulose (Metolose SM4000, manufactured by Shin-Etsu Chemical Co., Ltd.) | 2.0 parts |
| Emulsion-type ether polyurethane | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 5

A thermal transfer image receiving sheet related to Example 5 was obtained in the same manner as in Example 1 except that in the thermal transfer image receiving sheet prepared in Example 1, the undercoat layer was formed using a coating solution-5 for undercoat layer formation having the following formulation.

<Coating Solution-5 for Undercoat Layer Formation>

| | |
|---|---|
| Stannous chloride | 2.0 parts |
| Polyvinyl alcohol (PVA 424H, manufactured by Kuraray Co., Ltd.) | 1.5 parts |
| Emulsion-type ester polyurethane | 2.5 parts |
| Vinyl pyrrolidone-vinyl imidazole copolymer | 1.5 parts |
| Pure water | 61.0 parts |
| Ethyl alcohol | 28.0 parts |
| Isopropyl alcohol | 3.5 parts |

Example 6

A thermal transfer image receiving sheet related to Example 6 was obtained in the same manner as in Example 1 except that in the thermal transfer image receiving sheet prepared in Example 1, the undercoat layer was formed using a coating solution-6 for undercoat layer formation having the following formulation.

<Coating Solution-6 for Undercoat Layer Formation>

| | |
|---|---|
| Stannous chloride | 2.0 parts |
| Polyvinyl alcohol (PVA 424H, manufactured by Kuraray Co., Ltd.) | 1.5 parts |
| Ionomer-type ether polyurethane | 2.5 parts |
| Vinyl pyrrolidone-vinyl imidazole copolymer | 1.5 parts |
| Pure water | 61.0 parts |
| Ethyl alcohol | 28.0 parts |
| Isopropyl alcohol | 3.5 parts |

Example 7

A thermal transfer image receiving sheet related to Example 7 was obtained in the same manner as in Example 1 except that in the thermal transfer image receiving sheet prepared in Example 1, the undercoat layer was formed using a coating solution-7 for undercoat layer formation having the following formulation.

<Coating Solution-7 for Undercoat Layer Formation>

| | |
|---|---|
| Stannous chloride | 2.0 parts |
| Polyvinyl pyrrolidone (manufactured by ISP Japan Ltd.) | 1.5 parts |
| Emulsion-type ether polyurethane | 2.5 parts |
| Vinyl pyrrolidone-vinyl imidazole copolymer | 1.5 parts |
| Pure water | 61.0 parts |
| Ethyl alcohol | 28.0 parts |
| Isopropyl alcohol | 3.5 parts |

Example 8

A thermal transfer image receiving sheet related to Example 8 was obtained in the same manner as in Example 1 except that in the thermal transfer image receiving sheet prepared in Example 1, the undercoat layer was formed using a coating solution-8 for undercoat layer formation having the following formulation.

<Coating Solution-8 for Undercoat Layer Formation>

| | |
|---|---|
| Stannous chloride | 2.0 parts |
| Polyvinyl pyrrolidone (manufactured by ISP Japan Ltd.) | 1.5 parts |
| Ionomer-type ether polyurethane | 2.5 parts |
| Vinyl pyrrolidone-vinyl imidazole copolymer | 1.5 parts |
| Pure water | 61.0 parts |
| Ethyl alcohol | 28.0 parts |
| Isopropyl alcohol | 3.5 parts |

Example 9

A thermal transfer image receiving sheet related to Example 9 was obtained in the same manner as in Example 1 except that in the thermal transfer image receiving sheet prepared in Example 1, the undercoat layer was formed using a coating solution-9 for undercoat layer formation having the following formulation.

<Coating Solution-9 for Undercoat Layer Formation>

| | |
|---|---|
| Tetraethoxysilane | 6.0 parts |
| Polyvinyl alcohol (PVA 424H, manufactured by Kuraray Co., Ltd.) | 2.0 parts |
| Emulsion-type ester polyurethane | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 10

A thermal transfer image receiving sheet related to Example 10 was obtained in the same manner as in Example 1 except that in the thermal transfer image receiving sheet prepared in Example 1, the undercoat layer was formed using a coating solution-10 for undercoat layer formation having the following formulation.

<Coating Solution-10 for Undercoat Layer Formation>

| | |
|---|---|
| Tetraethoxysilane | 6.0 parts |
| Polyvinyl alcohol (PVA 424H, manufactured by Kuraray Co., Ltd.) | 2.0 parts |
| Ionomer-type ether polyurethane | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 11

A thermal transfer image receiving sheet related to Example 11 was obtained in the same manner as in Example 1 except that in the thermal transfer image receiving sheet prepared in Example 1, the undercoat layer was formed using a coating solution-11 for undercoat layer formation having the following formulation.

<Coating Solution-11 for Undercoat Layer Formation>

| | |
|---|---|
| Tetraethoxysilane | 6.0 parts |
| Polyvinyl pyrrolidone (manufactured by ISP Japan Ltd.) | 2.0 parts |
| Emulsion-type ester polyurethane | 2.0 parts |

-continued

| | |
|---|---|
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 12

A thermal transfer image receiving sheet related to Example 12 was obtained in the same manner as in Example 1 except that in the thermal transfer image receiving sheet prepared in Example 1, the undercoat layer was formed using a coating solution-12 for undercoat layer formation having the following formulation.

<Coating Solution-12 for Undercoat Layer Formation>

| | |
|---|---|
| Tetraethoxysilane | 6.0 parts |
| Polyvinyl pyrrolidone (manufactured by ISP Japan Ltd.) | 2.0 parts |
| Ionomer-type ether polyurethane | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 13

A thermal transfer image receiving sheet related to Example 13 was obtained in the same manner as in Example 1 except that in the thermal transfer image receiving sheet prepared in Example 1, the undercoat layer was formed using a coating solution-13 for undercoat layer formation having the following formulation.

<Coating Solution-13 for Undercoat Layer Formation>

| | |
|---|---|
| Triisopropoxy aluminum | 6.0 parts |
| Polyvinyl alcohol (PVA 424H, manufactured by Kuraray Co., Ltd.) | 2.0 parts |
| Ester polyurethane emulsion | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 14

A thermal transfer image receiving sheet related to Example 14 was obtained in the same manner as in Example 1 except that in the thermal transfer image receiving sheet prepared in Example 1, the undercoat layer was formed using a coating solution-14 for undercoat layer formation having the following formulation.

<Coating Solution-14 for Undercoat Layer Formation>

| | |
|---|---|
| Triisopropoxy aluminum | 6.0 parts |
| Polyvinyl alcohol (PVA 424H, manufactured by Kuraray Co., Ltd.) | 2.0 parts |
| Ionomer-type Ether polyurethane | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 15

A thermal transfer image receiving sheet related to Example 15 was obtained in the same manner as in Example 1 except that in the thermal transfer image receiving sheet prepared in Example 1, the undercoat layer was formed using a coating solution-15 for undercoat layer formation having the following formulation.

<Coating Solution-15 for Undercoat Layer Formation>

| | |
|---|---|
| Triisopropoxy aluminum | 6.0 parts |
| Polyvinyl pyrrolidone (manufactured by ISP Japan Ltd.) | 2.0 parts |
| Emulsion-type ester polyurethane | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Example 16

A thermal transfer image receiving sheet related to Example 16 was obtained in the same manner as in Example 1 except that in the thermal transfer image receiving sheet prepared in Example 1, the undercoat layer was formed using a coating solution-16 for undercoat layer formation having the following formulation.

<Coating Solution-16 for Undercoat Layer Formation>

| | |
|---|---|
| Triisopropoxy aluminum | 6.0 parts |
| Polyvinyl pyrrolidone (manufactured by ISP Japan Ltd.) | 2.0 parts |
| Ionomer-type ether polyurethane | 2.0 parts |
| Vinyl pyrrolidone-vinyl imidazole copolymer | 2.5 parts |
| 0.1N hydrochloric acid | 51.5 parts |
| Pure water | 32.5 parts |
| Isopropyl alcohol | 3.5 parts |

Comparative Example 1

A thermal transfer image receiving sheet related to Comparative Example 1 was obtained in the same manner as in Example 1 except that in the thermal transfer image receiving sheet prepared in Example 1, the undercoat layer was formed using a coating solution-17 for undercoat layer formation having the following formulation.

<Coating Solution-17 for Undercoat Layer Formation>

| | |
|---|---|
| Stannous chloride | 2.5 parts |
| Polyvinyl alcohol (PVA 424H, manufactured by Kuraray Co., Ltd.) | 1.9 parts |
| Emulsion-type ester polyurethane | 3.1 parts |
| Pure water | 61.0 parts |
| Ethyl alcohol | 28.0 parts |
| Isopropyl alcohol | 3.5 parts |

Comparative Example 2

A thermal transfer image receiving sheet related to Comparative Example 2 was obtained in the same manner as in Example 1 except that in the thermal transfer image receiving sheet prepared in Example 1, the undercoat layer was formed using a coating solution-18 for undercoat layer formation having the following formulation.

<Coating Solution-18 for Undercoat Layer Formation>

| | |
|---|---|
| Stannous chloride | 3.1 parts |
| Polyvinyl alcohol (PVA 424H, manufactured by Kuraray Co., Ltd.) | 2.2 parts |
| Vinyl pyrrolidone-vinyl imidazole copolymer | 2.2 parts |
| Pure water | 61.0 parts |
| Ethyl alcohol | 28.0 parts |
| Isopropyl alcohol | 3.5 parts |

Comparative Example 3

A thermal transfer image receiving sheet related to Comparative Example 3 was obtained in the same manner as in Example 1 except that in the thermal transfer image receiving sheet prepared in Example 1, the undercoat layer was formed using a coating solution-19 for undercoat layer formation having the following formulation.

<Coating Solution-19 for Undercoat Layer Formation>

| | |
|---|---|
| Stannous chloride | 2.5 parts |
| Emulsion-type ester polyurethane | 3.1 parts |
| Vinyl pyrrolidone-vinyl imidazole copolymer | 1.9 parts |
| Pure water | 61.0 parts |
| Ethyl alcohol | 28.0 parts |
| Isopropyl alcohol | 3.5 parts |

Comparative Example 4

A thermal transfer image receiving sheet related to Comparative Example 4 was obtained in the same manner as in Example 1 except that in the thermal transfer image receiving sheet prepared in Example 1, the undercoat layer was formed using a coating solution-20 for undercoat layer formation having the following formulation.

<Coating Solution-20 for Undercoat Layer Formation>

| | |
|---|---|
| Polyvinyl alcohol (PVA 424H, manufactured by Kuraray Co., Ltd.) | 2.1 parts |
| Emulsion-type ester polyurethane | 3.3 parts |
| Vinyl pyrrolidone-vinyl imidazole copolymer | 2.1 parts |
| Pure water | 61.0 parts |
| Ethyl alcohol | 28.0 parts |
| Isopropyl alcohol | 3.5 parts |

Comparative Example 5

A thermal transfer image receiving sheet related to Comparative Example 5 was obtained in the same manner as in Example 1 except that in the thermal transfer image receiving sheet prepared in Example 1, the undercoat layer was formed using a coating solution-21 for undercoat layer formation having the following formulation.

<Coating Solution-21 for Undercoat Layer Formation>

| | |
|---|---|
| Stannous chloride | 4.3 parts |
| Polyvinyl alcohol (PVA 424H, manufactured by Kuraray Co., Ltd.) | 3.2 parts |
| Pure water | 61.0 parts |
| Ethyl alcohol | 28.0 parts |
| Isopropyl alcohol | 3.5 parts |

Comparative Example 6

A thermal transfer image receiving sheet related to Comparative Example 6 was obtained in the same manner as in Example 1 except that in the thermal transfer image receiving sheet prepared in Example 1, the undercoat layer was formed using a coating solution-22 for undercoat layer formation having the following formulation.

<Coating Solution-22 for Undercoat Layer Formation>

| | |
|---|---|
| Stannous chloride | 3.3 parts |
| Emulsion-type ester polyurethane | 4.2 parts |
| Pure water | 61.0 parts |
| Ethyl alcohol | 28.0 parts |
| Isopropyl alcohol | 3.5 parts |

Comparative Example 7

A thermal transfer image receiving sheet related to Comparative Example 7 was obtained in the same manner as in Example 1 except that in the thermal transfer image receiving sheet prepared in Example 1, the undercoat layer was formed using a coating solution-23 for undercoat layer formation having the following formulation.

<Coating Solution-23 for Undercoat Layer Formation>

| | |
|---|---|
| Stannous chloride | 4.3 parts |
| Vinyl pyrrolidone-vinyl imidazole copolymer | 3.2 parts |
| Pure water | 61.0 parts |
| Ethyl alcohol | 28.0 parts |
| Isopropyl alcohol | 3.5 parts |

Comparative Example 8

A thermal transfer image receiving sheet related to Comparative Example 8 was obtained in the same manner as in Example 1 except that in the thermal transfer image receiving sheet prepared in Example 1, the undercoat layer was formed using a coating solution-24 for undercoat layer formation having the following formulation.

<Coating Solution-24 for Undercoat Layer Formation>

| | |
|---|---|
| Polyvinyl alcohol (PVA 424H, manufactured by Kuraray Co., Ltd.) | 2.8 parts |
| Emulsion-type ester polyurethane | 4.7 parts |
| Pure water | 61.0 parts |
| Ethyl alcohol | 28.0 parts |
| Isopropyl alcohol | 3.5 parts |

Comparative Example 9

A thermal transfer image receiving sheet related to Comparative Example 9 was obtained in the same manner as in Example 1 except that in the thermal transfer image receiving sheet prepared in Example 1, the undercoat layer was formed using a coating solution-25 for undercoat layer formation having the following formulation.

<Coating Solution-25 for Undercoat Layer Formation>

| | |
|---|---|
| Polyvinyl alcohol (PVA 424H, manufactured by Kuraray Co., Ltd.) | 3.7 parts |

-continued

| | |
|---|---|
| Vinyl pyrrolidone-vinyl imidazole copolymer | 3.7 parts |
| Pure water | 61.0 parts |
| Ethyl alcohol | 28.0 parts |
| Isopropyl alcohol | 3.6 parts |

Comparative Example 10

A thermal transfer image receiving sheet related to Comparative Example 10 was obtained in the same manner as in Example 1 except that in the thermal transfer image receiving sheet prepared in Example 1, the undercoat layer was formed using a coating solution-26 for undercoat layer formation having the following formulation.

<Coating Solution-26 for Undercoat Layer Formation>

| | |
|---|---|
| Emulsion-type ester polyurethane | 4.7 parts |
| Vinyl pyrrolidone-vinyl imidazole copolymer | 2.8 parts |
| Pure water | 61.0 parts |
| Ethyl alcohol | 28.0 parts |
| Isopropyl alcohol | 3.5 parts |

Comparative Example 11

A thermal transfer image receiving sheet related to Comparative Example 11 was obtained in the same manner as in Example 1 except that in the thermal transfer image receiving sheet prepared in Example 1, the undercoat layer was formed using a coating solution-27 for undercoat layer formation having the following formulation.

<Coating Solution-27 for Undercoat Layer Formation>

| | |
|---|---|
| Stannous chloride | 7.5 parts |
| Pure water | 61.0 parts |
| Ethyl alcohol | 28.0 parts |
| Isopropyl alcohol | 3.5 parts |

Comparative Example 12

A thermal transfer image receiving sheet related to Comparative Example 12 was obtained in the same manner as in Example 1 except that in the thermal transfer image receiving sheet prepared in Example 1, the undercoat layer was formed using a coating solution-28 for undercoat layer formation having the following formulation.

<Coating Solution-28 for Undercoat Layer Formation>

| | |
|---|---|
| Polyvinyl alcohol (PVA 424H, manufactured by Kuraray Co., Ltd.) | 7.5 parts |
| Pure water | 61.0 parts |
| Ethyl alcohol | 28.0 parts |
| Isopropyl alcohol | 3.5 parts |

Comparative Example 13

A thermal transfer image receiving sheet related to Comparative Example 13 was obtained in the same manner as in Example 1 except that in the thermal transfer image receiving sheet prepared in Example 1, the undercoat layer was formed using a coating solution-29 for undercoat layer formation having the following formulation.

<Coating Solution-29 for Undercoat Layer Formation>

| | |
|---|---|
| Emulsion-type ester polyurethane | 7.5 parts |
| Pure water | 61.0 parts |
| Ethyl alcohol | 28.0 parts |
| Isopropyl alcohol | 3.5 parts |

Comparative Example 14

A thermal transfer image receiving sheet related to Comparative Example 14 was obtained in the same manner as in Example 1 except that in the thermal transfer image receiving sheet prepared in Example 1, the undercoat layer was formed using a coating solution-30 for undercoat layer formation having the following formulation.

<Coating Solution-30 for Undercoat Layer Formation>

| | |
|---|---|
| Vinyl pyrrolidone-vinyl imidazole copolymer | 7.5 parts |
| Pure water | 61.0 parts |
| Ethyl alcohol | 28.0 parts |
| Isopropyl alcohol | 3.5 parts |

Comparative Example 15

Such a coating solution for dye-receiving layer formation as used in Example 1 was coated on the skin layer side of the foamed polypropylene film of Example 1 without formation of an undercoat layer in a dry thickness of 3 μm and dried to form a dye-receiving layer. In this way, a thermal transfer image receiving sheet related to Comparative Example 15 was obtained.

<Fabrication of Thermal Transfer Recording Medium>

A 4.5 μm thick polyethylene terephthalate film having undergone an easy-to-adhesion treatment on one surface thereof was provided as a substrate. A coating solution for forming a heat-resistant, lubrication layer having the following formulation was coated on a surface opposite to the easy-to-adhesion treatment surface in a dry coating amount of 1.0 g/m$^2$ and dried to obtain the substrate having the heat-resistant, lubrication layer attached thereon.

Next, a coating solution for thermal transfer layer formation having the following formulation was coated onto the easy-to-adhesion treatment surface of the heat-resistant, lubrication layer-attached substrate in a dry coating amount of 1.0 g/m$^2$ and dried to form a thermal transfer layer. In this way, a thermal transfer recording medium was obtained.

<Coating Solution for Forming a Heat-Resistant, Lubrication Layer>

| | |
|---|---|
| Silicone-based acrylic graft polymer (US-350, manufactured by Toagosei Co., Ltd.) | 50.0 parts |
| Methyl ethyl ketone | 50.0 parts |

<Coating Solution for Thermal Transfer Layer Formation>

| | |
|---|---|
| C.I. Solvent Blue 36 | 2.5 parts |
| C.I. Solvent Blue 63 | 2.5 parts |
| Polyvinyl acetal resin | 5.0 parts |
| Toluene | 45.0 parts |
| Methyl ethyl ketone | 45.0 parts |

<Printing Evaluation>

The thermal transfer image receiving sheets of Examples 1 to 16 and Comparative Examples 1 to 15 and the thermal transfer recording medium were used, and a solid image was printed using a thermal printer for evaluation, which had a resolution of 300×300 DPI and a printing speed capable of being switched between 1.5 msec/line and 1.4 msec/line, after which the following evaluations were made.

With the case using a printing speed of 1.5 msec/line ordinarily employed in existing high-speed printers, a maximum reflection density, an abnormal transfer and a peeling test were evaluated. Moreover, the printer was set in a high temperature and high humidity environment and printing was carried out at a printing speed of 1.5 msec/line as with the above case for glitter evaluation. With the case using a printing speed of 1.4 msec/line that is higher than that of existing high-speed printers, an abnormal transfer and a peeling test were evaluated. The results of the evaluations are shown in Table 1. It will be noted that the abnormal transfer used herein means that when thermal transfer is effected, peeling between any adjacent layers at the side of the thermal transfer image receiving sheet occurs to cause transfer to the thermal transfer layer.

(Measurement of Maximum Reflection Density)

The maximum reflection density was measured by use of X-rite 528.

(Evaluation of Abnormal Transfer)

The abnormal transfer was evaluated according to the following standards.

○: No occurrence of abnormal transfer x: Partial occurrence of abnormal transfer xx: Occurrence of abnormal transfer over full surface (Evaluation of Peeling Test)

The peeling test was carried out by attaching cellotape (registered trade name) CT-24 (manufactured by Nichiban Co., Ltd.) to the solid image. The peeling test was evaluated according to the following standards.

○: No peeling

Δ: Peeling of an area that is less than ¼ of the area attached with the cellotape (registered trade name) in any of the layers x: Peeling of an area that is not less than ¼ of the area attached with the cellotape (registered trade name) in any of the layers (Evaluation of Glitter)

The glitter was visually evaluated according to the following standards.

○: No glitter could be visually confirmed.

x: Glitter could be visually confirmed.

TABLE 1

| | 1.5 msec/line | | | | 1.4 msec/line | |
|---|---|---|---|---|---|---|
| | Maximum reflection density | Abnormal transfer | Peeling test | Glitter under high temperature and high humidity environments | Abnormal transfer | Peeling test |
| Example 1 | 2.13 | ○ | ○ | ○ | ○ | Δ |
| Example 2 | 2.14 | ○ | ○ | ○ | ○ | ○ |
| Example 3 | 2.19 | ○ | ○ | ○ | ○ | Δ |
| Example 4 | 2.14 | ○ | ○ | ○ | ○ | Δ |
| Example 5 | 2.18 | ○ | ○ | ○ | ○ | ○ |
| Example 6 | 2.18 | ○ | ○ | ○ | ○ | ○ |
| Example 7 | 2.15 | ○ | ○ | ○ | ○ | ○ |
| Example 8 | 2.16 | ○ | ○ | ○ | ○ | ○ |
| Example 9 | 2.20 | ○ | ○ | ○ | ○ | ○ |
| Example 10 | 2.21 | ○ | ○ | ○ | ○ | ○ |
| Example 11 | 2.18 | ○ | ○ | ○ | ○ | ○ |
| Example 12 | 2.20 | ○ | ○ | ○ | ○ | ○ |
| Example 13 | 2.19 | ○ | ○ | ○ | ○ | ○ |
| Example 14 | 2.19 | ○ | ○ | ○ | ○ | ○ |
| Example 15 | 2.18 | ○ | ○ | ○ | ○ | ○ |
| Example 16 | 2.19 | ○ | ○ | ○ | ○ | ○ |
| Comparative Example 1 | 2.18 | ○ | ○ | X | ○ | ○ |
| Comparative Example 2 | 2.18 | ○ | Δ | ○ | X | X |
| Comparative Example 3 | 1.96 | ○ | ○ | ○ | ○ | ○ |
| Comparative Example 4 | 2.14 | ○ | Δ | ○ | X | X |
| Comparative Example 5 | 2.18 | ○ | Δ | X | X | X |
| Comparative Example 6 | 1.96 | ○ | ○ | X | ○ | ○ |
| Comparative Example 7 | 1.94 | X | X | ○ | XX | — |
| Comparative Example 8 | 2.14 | ○ | Δ | X | X | X |
| Comparative Example 9 | 2.13 | X | X | ○ | XX | — |
| Comparative Example 10 | 1.94 | ○ | Δ | ○ | X | X |
| Comparative Example 11 | 1.94 | X | X | X | XX | — |

TABLE 1-continued

| | 1.5 msec/line | | | | 1.4 msec/line | |
|---|---|---|---|---|---|---|
| | Maximum reflection density | Abnormal transfer | Peeling test | Glitter under high temperature and high humidity environments | Abnormal transfer | Peeling test |
| Comparative Example 12 | 2.13 | X | X | X | XX | — |
| Comparative Example 13 | 1.94 | ○ | Δ | X | X | X |
| Comparative Example 14 | 1.93 | X | X | ○ | XX | — |
| Comparative Example 15 | — | XX | — | X | XX | — |

As will become apparent from the results shown in Table 1, when the thermal transfer image receiving sheets, which were, respectively, provided with the undercoat layers formed by coating and drying coating solutions each comprised, as main components, of at least one of an alkoxide, a hydrolyzate of an alkoxide and tin chloride, a water-soluble polymer, a vinyl pyrrolidone-vinyl imidazole copolymer and a urethane resin, were subjected to printing at a printing speed of 1.5 msec/line of existing high-speed printers, the maximum reflection densities were quite high and no abnormal transfer deficiency occurred. Moreover, with the thermal transfer image receiving sheets, the respective layers thereof did not suffer peeling in the peeling test and had thus satisfactory adhesion strength, and no glitter could be recognized by visual observation of the prints under high temperature and high humidity environments. Thus, the effects of the embodiments of the invention could be confirmed.

In Examples 2, 5 to 16 wherein an ester polyurethane or an ionomers-type polyurethane was used as the urethane resin, when printing was effected at a speed of 1.4 msec/line that was higher than that of existing high-speed printers, no peeling from any layer of the thermal transfer image receiving sheets was found in the peeling test of printed matter and satisfactory adhesion strength was ensured. Thus, the effects of the embodiments of the invention could be confirmed.

The use of polyvinyl alcohol as a water-soluble polymer in Examples 3, 5, 6, 9, 10, 13 and 14 and also of polyvinyl pyrrolidone as a water-soluble polymer in Examples 7, 8, 11, 12, 15 and 16 leads to greater maximum reflection densities, from which the effects of the embodiments of the invention could be confirmed.

The use of tetraethoxysilane in Examples 4 and 9 to 12 and of triisopropoxy aluminum in Examples 13 to 16 resulted in quite high maximum reflection densities and no occurrence of abnormal transfer deficiency at a printing speed of 1.5 msec/line of existing high-speed printers. Moreover, when using such materials as indicated, any layer of the thermal transfer image receiving sheets was not peeled off in the peeling test and thus, satisfactory adhesion strength was ensured. Therefore, the effects of the embodiments of the invention could be confirmed.

In contrast, with the thermal transfer image receiving sheets of Comparative Examples 1, 5, 6, 8 and 11 to 13, since no vinyl pyrrolidone-vinyl imidazole copolymer was used in the undercoat layer, such results were obtained that when printing was effected under high temperature and high humidity environments, glitter could be recognized by visual observation.

With the thermal transfer image receiving sheets of Comparative Examples 2, 5, 7, 9, 11, 12 and 14 wherein no urethane resin was used in the undercoat layer, it could be confirmed that the printing speed of 1.5 msec/line resulted in partial peeling between the heat-insulating layer and the undercoat layer in the peeling test or the occurrence of abnormal transfer.

It was found that since the thermal transfer image receiving sheets of Comparative Examples 3, 6, 7, 10, 11, 13 and 14 made no use of a water-soluble polymer in the undercoat layer, the maximum reflection density considerably lowered.

Since the thermal transfer image receiving sheets of Comparative Examples 4, 8, 9, 10, 12, 13 and 14 made no use of at least one of tin chloride, an alkoxide and its hydrolyzate in the undercoat layer, partial peeling between the heat-insulating layer and the undercoat layer or abnormal transfer occurred in the peeling test at the printing speed of 1.5 msec/line. At the printing speed of 1.4 msec/line, the occurrence of abnormal transfer was entailed.

The thermal transfer image receiving sheet of Comparative Example 15 was provided with no undercoat layer between the dye-receiving layer and the heat-insulating layer, abnormal transfer occurred over the entire surface. As a consequence, the measurement of the maximum reflection density could not be carried out.

Although the present invention has been described above with reference to specific embodiments and examples, the invention should not be construed as limited to these descriptions. Other alterations of the invention will become apparent along with various modifications of the disclosed embodiment by reference to the descriptions of the invention. Accordingly, the appended claims of the present invention should be construed to cover these modifications or embodiments as falling within the scope and spirit of the invention.

The thermal transfer image receiving sheet and its fabrication method related to the embodiments set forth hereinbefore could solve the problems addressed in the present application. The details of the peripheral technology related to the embodiments of the invention and the problems to be solved thereby are now described.

In general, the thermal transfer recording medium is employed in thermal transfer printers and means an ink ribbon called thermal ribbon. This transfer recording medium is constituted of a thermal transfer layer formed on one surface of a substrate layer and a heat-resistant lubricating layer (back coat layer) formed on the other surface thereof. The thermal transfer layer is an ink layer and is transferred to the side of a thermal transfer image receiving sheet by sublimation (sublimation transfer method) or by melting (melt transfer method) of an ink by application of heat from a thermal head of a printer.

At present, the sublimation transfer method in the thermal transfer methods is able to simply form various images in full color with the aid of high-performance printers and has wide utility for self-printing of digital cameras, cards such as an identification card, and an output object for amusement. Along with a diversity of such uses, downsizing, high speed performance, cost reduction and durability of the resulting printed matter have been eagerly demanded. In recent years, there have been in wide use thermal transfer recording mediums of the type having a plurality of thermal transfer layers provided on one side of a substrate sheet, and a protection layer capable of imparting durability to a printed matter and provided on the same side of the substrate sheet as not superposed therewith.

Under such circumstances as stated above, as the printing speed of printers is upgraded to a higher speed in association with the diversity of uses and widespread diffusion, a problem is presented in that a satisfactory print density cannot be obtained when using existing thermal transfer recording mediums and thermal transfer image receiving sheets. To solve the problem that a satisfactory print density cannot be obtained, there have been proposed thermal transfer image receiving sheets using specific types of resins in dye-receiving layers or specific types of resins or resin films in heat-insulating layers. However, a problem is involved in the adhesion between a dye-receiving layer and a heat-insulating layer, between a dye-receiving layer and an undercoat layer or between an undercoat layer and a heat-insulating layer, with some concern that a problem is raised that peeling from any layer at the side of the dye-receiving layer of the thermal transfer image receiving sheet occurs during printing, followed by melting on the surface of a thermal transfer layer to generate abnormal transfer.

Further, in existing high-speed printing printers and particularly, in printing under high temperature and high humidity environments, a hue variation occurs due to the thermal fusion between the thermal transfer layer and the dye-receiving layer. This results in the lowering of a maximum reflection density due to the partial matting of the surface of a printed matter to generate so-called "glitter" wherein the maximum reflection density lowers.

To solve the such problems as set out above, there has been proposed, for example, in PTL 1 a thermal transfer image receiving sheet having good adhesion to a substrate and a high print density wherein an image-receiving layer containing an alkoxysilyl group-containing urethane resin is stacked on an intermediate layer (heat-insulating layer) containing hollow particles.

Further, PTL 2 has proposed a dye-receiving element improved in adhesion of a dye-receiving layer to a support by providing an undercoat layer between the polyolefin support and the dye-receiving layer wherein the undercoat layer is made of a polymer having an inorganic main chain of titanium oxide formed of an organic titanate or a titanium alkoxide.

PTL3 has proposed a dye-receiving element improved in adhesion of a dye-receiving layer to a support by providing an undercoat layer between the polyolefin support and the dye-receiving layer wherein the undercoat layer is made of a polymer having an inorganic main chain of zirconium oxide formed of an organic zirconate or a zirconium alkoxide.

In PTLs 4 and 5, there have been proposed thermal transfer image receiving sheets, in which a barrier layer containing a specific type of resin is provided between a receiving layer and a porous layer and which have good in adhesion to the receiving layer and excellent in solvent resistance and is of no practical problem with respect to "scorch (glitter)" wherein a maximum reflection density lowers.

When the thermal transfer image receiving sheet proposed in PTL 1 was used to effect printing with an existing high-speed printer, it was confirmed that adhesion to the substrate was good. However, a satisfactory print density could not be obtained.

Moreover, when the dye-receiving elements proposed in PTLs 2 and 3 were used to effect printing using an existing high-speed printer, a satisfactory print density could not be obtained. Additionally, abnormal transfer occurred wherein the dye-receiving layer was fused on the surface of the thermal transfer layer.

When the thermal transfer sheets proposed in PTLs 4 and 5 were used to effect printing by use of an existing high-speed printer, it was found that scorch (glitter) occurred whereby a practical problem was caused under high temperature and high humidity environments The use of a diversity of binders, additives and resin films has been hitherto reported with respect to the dye-receiving layer, undercoat layer and heat-insulating layer.

However, where high-speed printing is effected by use of existing high-speed printers, some thermal transfer image receiving sheets related to prior art show a low print density and poor adhesion to a substrate along with glitter occurring at the time of high speed printing under high temperature and high humidity environments.

(Effects of the Present Embodiment)

(1) When comparing with prior-art thermal transfer image receiving sheets having such problems as stated above, a thermal transfer image receiving sheet 1 related to the present embodiment includes a heat-insulating layer 3, an undercoat layer 4 and a dye-receiving layer 5 successively stacked on one surface of a substrate 2 wherein the undercoat layer 4 is comprised, as a main component, of a polycondensate formed by using at least one of an alkoxide, a hydrolyzate of an alkoxide, a water-soluble polymer, a vinyl pyrrolidone-vinyl imidazole copolymer and a urethane resin.

When the sheet configured as described above is subjected to high-speed printing by use of existing high-speed printers, there are ensured a adequately high print density and good substrate adhesion, particularly to the heat-insulating layer 3 and also to the dye-receiving layer 5. Additionally, when high-speed printing is effected under high temperature and high humidity environments, the occurrence of glitter can be mitigated.

(2) The urethane resin in the thermal transfer image receiving sheet 1 can be at least one of an ester polyurethane resin and an ionomer-type polyurethane resin.

With such a configuration as mentioned above, interlayer adhesion strength can be enhanced. Accordingly, if printing is performed at a speed higher than that of existing high-speed printers, no peeling occurs from any layer of the thermal transfer image receiving sheet.

(3) The water-soluble polymer in the thermal transfer image receiving sheet 1 can be at least one of polyvinyl alcohol and polyvinyl pyrrolidone.

With such a configuration as mentioned above, the maximum reflection density can be more increased.

(4) The alkoxide in the thermal transfer image receiving sheet 1 can be at least one of tetraethoxysilane and triisopropoxy aluminum.

With such a configuration as mentioned above, the maximum reflection density can be adequately high even at a printing speed corresponding to that of existing high-speed printers. Additionally, the deficiency of abnormal transfer can be mitigated. Moreover, interlayer adhesion strength can be enhanced.

(5) In contrast with methods of fabricating prior-art thermal transfer image receiving sheets having such problems as set out above, according to a method for fabricating a thermal transfer image receiving sheet 1 related to the present embodiment, a heat-insulating layer 3, an undercoat layer 4 and a dye-receiving layer 5 are successively stacked on one surface of a substrate 2. The undercoat layer 4 is formed by coating and drying, onto the heat-insulating layer 3, a coating solution for undercoat layer formation, which is adjusted to comprise, as main components in the undercoat layer 4 after its formation, at least one of an alkoxide, a hydrolyzate of an alkoxide and tin chloride, a water-soluble polymer, a vinyl pyrrolidone-imidazole copolymer, and a urethane resin.

With such a configuration as set out above, when high-speed printing is effected by use of existing high-speed printers, there can be fabricated a thermal transfer image receiving sheet 1 that is adequately high in print density, is good in substrate adhesion and particularly, adhesion to the heat-insulating layer 3 and the dye-receiving layer 5, and is mitigated with respect to the occurrence of glitter at the time of high-speed printing under high temperature and high humidity environments.

(6) The urethane resin used in the fabrication method of the thermal transfer image receiving sheet 1 can be at least one of an ester polyurethane resin and an ionomer-type polyurethane resin.

With such a configuration as mentioned above, there can be fabricated a thermal transfer image receiving sheet whose interlayer adhesion strength is increased. Accordingly, when printing is effected at a speed higher than that of existing high-speed printers, there can be fabricated a thermal transfer image receiving sheet 1 involving no peeling from any layer of the thermal transfer image receiving sheet.

(7) The water-soluble polymer used in the fabrication method of the thermal transfer image receiving sheet 1 can be at least one of polyvinyl alcohol and polyvinyl pyrrolidone.

With such a configuration as mentioned above, there can be fabricated a thermal transfer image receiving sheet 1 whose maximum reflection density is further enhanced.

(8) The alkoxide used in the fabrication method of a thermal transfer image receiving sheet 1 can be at least one of tetraethoxysilane and triisopropoxy aluminum.

With such a configuration as mentioned above, when printing is effected at a printing speed corresponding to that of existing high-speed printers, there can be fabricated a thermal transfer image receiving sheet 1 whose maximum reflection density is adequately high. Additionally, such a thermal transfer image receiving sheet 1 having an abnormal transfer deficiency mitigated can be fabricated. Moreover, the thermal transfer image receiving sheet 1 having enhanced interlayer adhesion strength can be fabricated.

The thermal transfer image receiving sheet related to prior art techniques as mentioned above have a problem in that where high-speed printing is carried out by use of existing high-speed printers, a print density is low and adhesion to a substrate is not good, and scorch (glitter) may occur in some cases when high-speed printing is performed under high temperature and high humidity environments.

An embodiment of the present invention has been made while paying attention to such a problem as mentioned above, and can provide a thermal transfer image receiving sheet which is high in print density and is good in adhesion to a substrate when subjected to high-speed printing and which is able to mitigate the generation of glitter when high-speed printing is carried out under high temperature and high humidity environments, and a method for fabricating the same.

The present inventors have found that the above problem can be addressed by preparing a specific undercoat layer.

More particularly, a thermal transfer image receiving sheet according to one embodiment of the invention includes a heat-insulating layer, an undercoat layer and a dye-receiving layer successively stacked on one surface of a substrate, characterized in that the undercoat layer is comprised, as a main component, of a polycondensate that is formed by using at least one of an alkoxide, a hydrolyzate of an alkoxide and tin chloride, a water-soluble polymer, a vinyl pyrrolidone-vinyl imidazole copolymer, and a urethane resin.

According to one embodiment of the invention, there can be obtained a thermal transfer image receiving sheet, which is adequately high in print density and good in adhesion to the substrate, particularly in adhesion between the heat-insulating layer and the dye-receiving layer, when high-speed printing is performed by use of currently employed high-speed printers and which is able to mitigate the generation of glitter when high-speed printing is carried out under high temperature and high humidity environments.

INDUSTRIAL APPLICABILITY

The thermal transfer image receiving sheet obtained according to an embodiment of the invention can be used for sublimation transfer printers and can be widely used as self-prints of digital cameras, cards such as of identification, output objects for amusement and the like because a variety of images can be simply formed in full color in association with the high speed and high performance of printers.

REFERENCE SIGNS LIST

1: thermal transfer image receiving sheet
2: substrate
3: heat-insulating layer
4: undercoat layer
5: dye-receiving layer Obviously, numerous modifications and variations of the present invention are possible in light of the above teachings. It is therefore to be understood that within the scope of the appended claims, the invention may be practiced otherwise than as specifically described herein.

What is claimed is:

1. A thermal transfer image receiving sheet, comprising:
a substrate having a surface;
a heat-insulating layer formed on the surface;
an undercoat layer formed on the heat-insulating layer; and
a dye-receiving layer formed on the undercoat layer,
wherein the undercoat layer comprises as a main component a polycondensate made from i) at least one of an alkoxide, a hydrolyzate of an alkoxide, and tin chloride, ii) a water-soluble polymer, iii) a vinyl pyrrolidone-vinyl imidazole copolymer, and iv) a urethane resin.

2. The thermal transfer image receiving sheet of claim 1, wherein the urethane resin comprises at least one of an ester polyurethane resin and an ionomer-type polyurethane resin.

3. The thermal transfer image receiving sheet of claim 2, wherein the water-soluble polymer comprises at least one of polyvinyl alcohol and polyvinyl pyrrolidone.

4. The thermal transfer image receiving sheet of claim 3, wherein the alkoxide comprises at least one of tetraethoxysilane and triisopropoxy aluminum.

5. The thermal transfer image receiving sheet of claim 2, wherein the alkoxide comprises at least one of tetraethoxysilane and triisopropoxy aluminum.

6. The thermal transfer image receiving sheet of claim 1, wherein the water-soluble polymer comprises at least one of polyvinyl alcohol and polyvinyl pyrrolidone.

7. The thermal transfer image receiving sheet of claim 6, wherein the alkoxide comprises at least one of tetraethoxysilane and triisopropoxy aluminum.

8. The thermal transfer image receiving sheet of claim 1, wherein the alkoxide comprises at least one of tetraethoxysilane and triisopropoxy aluminum.

9. A method of manufacturing a thermal transfer image receiving sheet, comprising:

forming a layered structure on a surface of a substrate such that a heat-insulating layer is formed on the surface, an undercoat layer is formed on the heat-insulating layer, and a dye-receiving layer is formed on the undercoat layer, wherein the forming of the layered structure includes forming the undercoat layer on the heat-insulating layer by coating a solution to the heat-insulating layer and drying after the coating, and the solution has a composition such that the undercoat layer comprises as a main component a polycondensate made from i) at least one of an alkoxide, a hydrolyzate of an alkoxide, and tin chloride, ii) a water-soluble polymer, iii) a vinyl pyrrolidone-vinyl imidazole copolymer, and iv) a urethane resin.

10. The method of claim 9, wherein the urethane resin comprises at least one of an ester polyurethane resin and an ionomer-type polyurethane resin.

11. The method of claim 10, wherein the water-soluble polymer comprises at least one of polyvinyl alcohol and polyvinyl pyrrolidone.

12. The method of claim 11, wherein the alkoxide comprises at least one of tetraethoxysilane and triisopropoxy aluminum.

13. The method of claim 10, wherein the alkoxide comprises at least one of tetraethoxysilane and triisopropoxy aluminum.

14. The method of claim 9, wherein the water-soluble polymer comprises at least one of polyvinyl alcohol and polyvinyl pyrrolidone.

15. The method of claim 14, wherein the alkoxide comprises at least one of tetraethoxysilane and triisopropoxy aluminum.

16. The method of claim 9, wherein the alkoxide comprises at least one of tetraethoxysilane and triisopropoxy aluminum.

* * * * *